US008137063B2

(12) United States Patent
Haje et al.

(10) Patent No.: US 8,137,063 B2
(45) Date of Patent: Mar. 20, 2012

(54) COMPONENT OF A STEAM TURBINE PLANT, STEAM TURBINE PLANT, APPLICATION, AND PRODUCTION METHOD

(75) Inventors: Detlef Haje, Görlitz (DE); Dietmar Röttger, Mülheim a.d. Ruhr (DE); Friedhelm Schmitz, Dinslaken (DE)

(73) Assignee: Siemens Aktiengesellschaft, Munich (DE)

( * ) Notice: Subject to any disclaimer, the term of this patent is extended or adjusted under 35 U.S.C. 154(b) by 1192 days.

(21) Appl. No.: 11/918,304

(22) PCT Filed: Mar. 13, 2006

(86) PCT No.: PCT/EP2006/060664

§ 371 (c)(1), (2), (4) Date: Oct. 11, 2007

(87) PCT Pub. No.: WO2006/108746

PCT Pub. Date: Oct. 19, 2006

(65) Prior Publication Data

US 2009/0041578 A1 Feb. 12, 2009

(30) Foreign Application Priority Data

Apr. 14, 2005 (EP) ..... 05008207

(51) Int. Cl.
*F04D 29/44* (2006.01)

(52) U.S. Cl. ..... 415/196; 415/177; 415/200; 60/653

(58) Field of Classification Search ..... 415/176, 415/177, 200, 196, 197; 60/645, 646, 653
See application file for complete search history.

(56) References Cited

U.S. PATENT DOCUMENTS

| | | | | |
|---|---|---|---|---|
| 4,550,562 | A * | 11/1985 | Rice | 60/772 |
| 6,039,537 | A | 3/2000 | Scheurlen | |
| 6,322,322 | B1 | 11/2001 | Rhodes et al. | |
| 2002/0146584 | A1 * | 10/2002 | Fried | 428/609 |

FOREIGN PATENT DOCUMENTS

| | | | |
|---|---|---|---|
| EP | 0 374 603 | A1 | 6/1990 |
| EP | 0 658 724 | A2 | 6/1995 |
| EP | 1 475 567 | A1 | 11/2004 |
| JP | 52008543 | A | 1/1977 |
| JP | 59069516 | A | 4/1984 |
| JP | 61257466 | A | 11/1986 |
| JP | 63038565 | A | 2/1988 |

* cited by examiner

*Primary Examiner* — Edward Look
*Assistant Examiner* — Dwayne J White

(57) ABSTRACT

The aim of the invention is to provide a superheated component of a steam turbine installation with high thermal and mechanical resistance. To this end, the component comprises a lining applied to a body of the component, on a hot side facing a steam chamber, said lining being adapted to the contour of the component body. According to the invention, the lining comprises a number of molded parts, each molded part comprising a metallic and ceramic composite layer formed from at least one metallic layer and at least one ceramic layer. The ceramic layer is used especially as a insulating layer, and the metallic layer is especially used as a support or for protection against abrasion and/or erosion.

14 Claims, 1 Drawing Sheet

COMPONENT OF A STEAM TURBINE PLANT, STEAM TURBINE PLANT, APPLICATION, AND PRODUCTION METHOD

CROSS REFERENCE TO RELATED APPLICATIONS

This application is the US National Stage of International Application No. PCT/EP2006/060664, filed Mar. 31, 2006 and claims the benefit thereof. The International Application claims the benefits of European application No. 05008207.2 filed Apr. 14, 2005, both of the applications are incorporated by reference herein in their entirety.

FIELD OF INVENTION

The invention relates to a component of a steam turbine plant, for exposure to admission of superheated steam, with a hot side which faces a superheated steam space, which component has a contour and a lining. Furthermore, the invention relates to a steam turbine plant, an application, and a production method.

BACKGROUND OF THE INVENTION

A steam turbine plant customarily comprises the steam turbine as such and a steam turbine peripheral equipment arrangement. The peripheral equipment arrangement in this case serves inter alia for feed and discharge of superheated steam to or from the steam turbine respectively. By means of the peripheral equipment arrangement on the inlet side the superheated steam is fed to the turbine at a high temperature and to a turbine casing at high pressure. For this purpose, the superheated steam is first fed to an inflow region of the turbine, which basically extends between a connection of a steam boiler to the turbine and the start of a blading in the casing or on the rotor of the turbine, as the case may be. In the steam turbine, the superheated steam, as working medium, is passed by the turbine blades, cooling and expanding, and in this way drives the rotor of the turbine, yielding its thermal and kinetic energy. The rotation can be used for driving a generator and for producing electric current there. The expanded and cooled working medium can recirculate in the form of cooled and expanded steam in the peripheral equipment arrangement on the outlet side, for example via a condenser.

In order to increase the efficiency of such a steam turbine plant, it is necessary inter alia to increase the pressure and the temperature of the working medium, that is the superheated steam. This results in a multiplicity of additional or increased stresses of the materials which are used in the components with high thermal loads, especially in the peripheral equipment arrangement of the turbine plant, the inflow region, casing region or rotor region of the turbine of the turbine plant. Therefore, at high operating temperatures, for example on account of chemical reactions of the material with the working medium inter alia, an increased oxidation rate occurs, which leads to scaling to an increased degree. This is undesirable and causes multifarious problems, inter alia with regard to the sealing performance of the respective component or components which are connected downstream.

For solving such problems, up to now the solution has been to use more superior materials for the piping components and/or collecting components, especially in the peripheral equipment arrangement of the turbine plant, in the inflow region and/or in the casing region or rotor region of the turbine of the turbine plant. High temperatures of the components, however, as a rule also result in a lowering of the permissible mechanical stress, which in turn limits the use of still more superior materials not only in the components themselves, but also in their structural anchoring.

More superior materials are not only cost-intensive, but also labor-intensive with regard to their processing and their use. Principles of cooling for components of a steam turbine plant are basically known, however result in losses in efficiency of the entire plant.

Therefore, the solution has been to attach insulations, in part, especially in the case of components which are subjected to high thermal loads. Up to now, these were applied for example with pipes, boilers or headers of the peripheral equipment arrangement, within the scope of a spraying method in which a coating powder is thermally sprayed on.

In addition to this, it is known to attach heat insulating fabric on a hot side of a component of the peripheral equipment arrangement, which hot side faces a superheated steam space. Such heat insulating materials as a rule can be applied in layers with high thickness and in principle would be well suited. However, within the limits of higher operating temperatures and higher operating pressures, in the meantime the flow characteristics of steam flows in and/or on a component, for example already on account of the flow velocity, are aggressive in such a way that the aforementioned heat insulating materials prove to be insufficiently strong and after a short time can already be destroyed and/or detached, for example as a result of erosion, other abrasion, and/or as a result of oxidation. This effect is increased more by thermoshock stresses, which make the materials brittle or in any case create stresses. Detached heat insulating materials then get into the flow of the working medium and can lead to a further increasing of erosion damage both in the peripheral equipment arrangement and in the turbine of the turbine plant.

A lining with simultaneously high heat insulating characteristics and high abrasion resistances would be desirable. Up to now, increasing heat insulation by increasing a thickness of a heat insulating layer in the way which is explained above, leads to a reduction of the mechanical resistance. Increasing the mechanical resistance by reducing the thickness of a heat insulating layer, on the other hand leads to a lower thermal resistance, since the heat insulation also reduces with reducing thickness.

The invention starts at this point, the object of which is to disclose a component of a steam turbine plant for exposure to admission of superheated steam, a steam turbine plant, and also an application and a production method, according to which in equal measure a thermal and mechanical resistance of the component, even at increased temperature and pressure parameters of a superheated steam, especially at temperatures of above 600° C. and/or pressures of above 250 bar, is advantageously improved.

SUMMARY OF INVENTION

The object with regard to the component is achieved by a component which is mentioned in the introduction, in which according to the invention the lining is arranged in the region of the hot side of the component and is formed by a number of formed parts which are adapted to the contour, wherein a formed part is formed in each case as a metal and ceramic composite layer with at least one metal layer and at least one ceramic layer.

The invention starts from the consideration that a physical separation of a surface of a component from a superheated steam space which is exposed to admission of superheated steam is basically advantageous, i.e. the invention starts from providing a contour of a hot side of the component with a lining, which hot side faces a superheated steam space. Furthermore, the invention has also recognized, however, as distinct from the prior art, that significant limitations of the resistance of the component occurs owing to the thickness of such a lining, if this, in order to achieve increased efficiencies, is subjected to a working medium with high pressure and temperature parameters, especially >600° C. and/or >250 bar. With increasing thickness of a thermal insulation, its thermal insulating effect increases, but its mechanical resistance decreases in the manner which is explained in the introduction, especially in the case of thermoshock stress. With reducing thickness of the lining, the thermal insulating effect decreases and the mechanical-resistance increases under the influence of a working medium which, as a result of high temperatures and high pressures, has a high flow velocity and a high reactivity. The invention solves this conflict by the use of a lining in the form of a number of contour-adapted formed parts, which on the hot side have a metal and ceramic composite layer.

With regard to a first aspect of the invention, it has been specifically shown that in the case of a metal and ceramic composite layer, which is formed from a metal layer and a ceramic layer, a greater layer thickness can be achieved. The layers of the composite layer are advantageously interconnected in a bonding manner, especially intimately. However, they can also be connected by methods such as screwing, plugging in, or riveting. That is to say, for the aforementioned case of a composite layer, the thermal insulating effect of the lining can be increased, without the mechanical resistance being reduced in the process. The lining according to the new concept in the most diverse variants proves to be especially abrasion-resistant and erosion-resistant.

Furthermore, with regard to a second aspect of the invention, it has been shown that the attaching of a lining, depending upon the dimension of a component in the form of a number or a multiplicity of formed parts on the contour, not only increases the mechanical resistance of the lining, but also guarantees an improved adhesion of the lining on the hot side and, moreover, is insensitive to changing temperature and mechanical stresses in the high temperature and high pressure range. Surprisingly, even in turbine casings, for example in the inflow region of a turbine plant and also in piping components and/or collecting components, it has been shown that on account of their often angled and inaccessible construction, plasma spraying, or other thermal spraying methods, prove to be less reliable than an especially advantageously recognized lining in the form of a multiplicity of contour-adapted formed parts. A formed part in this case can itself preferably be bent, curved or arched in such a way that it matches a contour, for example in a precision-fitting manner, and in this sense is adapted to contour. This can especially be advantageous with small for example by sufficiently small formed parts being attached at random points of the contour components. A formed part itself can be planar, if required, especially with large components. All the same, the lining can be contour-adapted, for example by sufficiently small formed parts being attached at random points of the contour.

By means of the lining, which according to the new concept provides a combination of the two aforementioned aspects, the disadvantages of the prior art, which are described above are avoided. The mechanical, thermal and chemical stress on the hot side of the component is reduced by means of the lining according to the new concept. As a result, the possibility opens up of using current materials for higher working medium parameters, or, with constant parameters, using more cost-effective materials.

Furthermore, heat insulation inside the component, minimizing temperature drop from the inside outwards, minimizing heat loss flow and also chemical resistance, especially corrosion resistance, especially proves to be better compared with the prior art. These and further advantages are especially consolidated by advantageous developments of the invention, which are to be gathered from the dependent claims and which in detail disclose possibilities of realizing a component of a steam turbine plant for exposure to admission of superheated steam according to the new concept.

According to a first variant, the ceramic layer can be closer to the hot side than the metal layer. This has the advantage that the metal layer serves a mounting, fixing and backing of the ceramic layer. That is to say, the metal layer practically serves within the composite layer as a support layer for the ceramic layer. This increases the mechanical resistance of the composite layer as a whole, especially in the case of high mechanical stress within the scope of increased working medium parameters. The metal layer which is set back behind the ceramic layer, furthermore, is subjected to lower corrosion.

According to a second variant, the metal layer can be closer to the hot side than the ceramic layer. In this case, the metal layer serves within the composite layer particularly as abrasion protection and/or erosion protection for the ceramic layer. That is to say, the ceramic layer is less severely mechanically stressed by the flow, especially with high flow parameters.

In a third variant, the advantages of the two aforementioned variants are combined by the ceramic layer being arranged between a directly adjacent first metal layer and second metal layer. In this case, the support characteristic of the first metal layer on the cold side is combined with an erosion-protecting characteristic of a second metal layer on the hot side.

Within the scope of a fourth variant, the metal layer could basically also be arranged between a directly adjacent first ceramic layer and second ceramic layer. In this case, the metal layer can serve as an inner support layer and at the same time is protected by means of the ceramic layers against chemical and especially corrosive loads, especially on the hot side.

Which of the four variants proves to be advantageous in an individual case is to be determined with regard to a specific application. It has especially been shown that the thickness of a lining within the scope of the new concept, i.e. within the scope of a contour-adapted formed part with a composite layer which protects against mechanical, thermal and chemical loads, can already be realized by a composite layer thickness of above 2 mm. However, this is a thickness range which with linings according to the prior art would already lead to increased sensitivity to thermoshock, especially during the exposure of the component to admission of superheated steam at temperatures of above 600° C. and pressures of above 250 bar.

Developments of all four variants can be gathered from the further dependent claims, and are otherwise exemplarily described in detail with reference to the drawing.

The invention especially specifies a steam turbine plant with a component of the type which is exemplified above. An application of the component as a piping component and/or collecting component within the scope of a peripheral equipment arrangement of the steam turbine plant especially proves to be advantageous. Furthermore, an application of the component in a casing section, especially in the inflow region of a steam turbine of a steam turbine plant also proves to be advantageous. The inlet in this connection itself can be understood as a piping component.

It can also be advantageous to apply a lining formed part with a metal and ceramic composite layer on a hot side in the rotor region and blade region of a steam turbine.

With regard to the production method, the object according to the invention is achieved by means of a production method for a component of a steam turbine plant, for exposure to admission of superheated steam, which component has a hot side which faces a superheated steam space, and which has a contour. In this case, according to the invention, it is provided that the component body of the component is made available, a lining is applied, by a number of formed parts, which form the lining, being applied, wherein a contour-adapted formed part is provided, and, conforming to the course of the contour, is attached in a manner with a metal and ceramic composite layer oriented towards the hot side, wherein the composite layer is formed from at least one metal layer and at least one ceramic layer.

BRIEF DESCRIPTION OF THE DRAWINGS

Exemplary embodiments of the invention are subsequently described with reference to the drawing in the example of a pipe for a steam turbine. Furthermore, the invention also proves to be especially expedient for other components of a peripheral equipment arrangement of a steam turbine plant, for example the exemplary embodiment of a header, especially of an outlet header or of a boiler of a steam turbine plant. The drawing can also be read for such exemplary embodiments which in the present case are not explicitly mentioned, for example a component of a casing of an inflow region, or of a rotor or of a blade of a steam turbine. The drawing, where expedient for explanation, is laid out in a schematized and/or slightly distorted form. With regard to supplements of the doctrines which are directly recognizable from the drawing, the relevant prior art is referred to. In detail, in the drawing.

DETAILED DESCRIPTION OF INVENTION

Figure 1A:
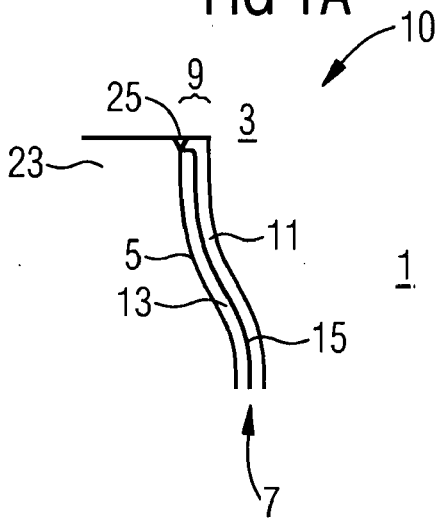
FIG. 1A shows a contour and a lining of a pipe within the scope of a first especially preferred embodiment according to the concept of the invention.
Figure 3:
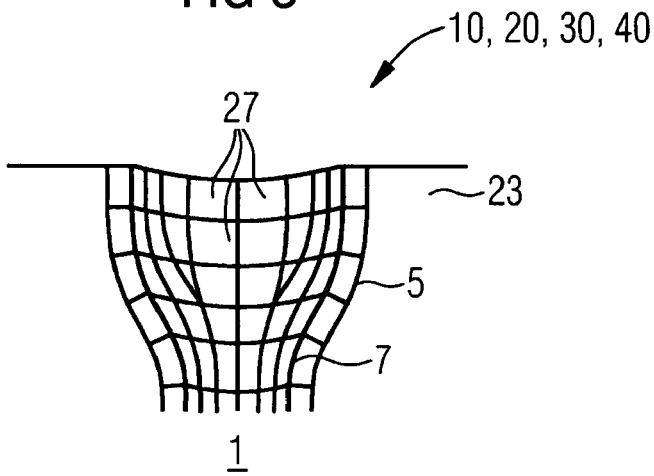
FIG. 3 shows a perspective sectional view of an inlet according to one of the aforementioned especially preferred embodiments.

FIG. 1A shows a piping component 10 in the form of a pipe of a steam turbine peripheral equipment arrangement or in the inflow region of a steam turbine for exposure to admission of superheated steam, wherein the steam turbine is not shown in detail. A component can be produced for example from 9-12% Cr-steel material. The piping component 10 has a hot side 3 which faces a superheated steam space 1, and has a contour 5 and a lining 7. The lining 7 is formed on the contour 5 in the form of a multiplicity of formed parts 27, which are shown in FIG. 3, wherein the lining is shown in section in FIG. 1A, and in FIG. 3 is shown as a perspective sectional view and explained in detail with regard to the formed parts 27.

A formed part 27 of the lining 7, which is not shown in detail in FIG. 1A, is adapted in its curved form to the curved contour 5, as the section of the lining shows. That is to say, the formed part 27 is basically curved like the contour 5, extends parallel to the contour 5, and faces the hot side 3 of the piping component 10. On the hot side 3, the formed part 27 has a metal and ceramic double composite layer 9 which is formed from just one metal layer 11 and just one ceramic layer 13. The metal layer 11 and the ceramic layer 13 are especially interconnected in a bonding manner in an intimate way.

Within the scope of the embodiment of a piping component 10 which is shown in FIG. 1A, the hot side 3 has the metal and ceramic composite layer 9 directly on the contour 5 of the component body 23 of the component 10. The composite layer 9 as such is mechanically fastened on the contour 5. In the production method, this, for example, can be carried out by a dowelled, threaded, or welded connection. The lining 7 comprises the composite layer 9. It has been specifically shown that in the peripheral equipment arrangement of steam turbines, for the temperature range of below 1000° C., a formed part with a composite layer 9 with a thickness of greater than 2 mm can be formed. This is a measure which far exceeds customary heat insulating layers, and the composite layer 9 still proves to be thermally and mechanically exceptionally resistant. Customary heat insulating layers in the form of a lining are plasma-sprayed or vapor-deposited, and cannot at all be manufactured for such a thickness, even if they were to have no adequate mechanical resistance, but which becomes possible within the scope of the new concept by means of a corresponding formed part.

Advantageous heat insulating effects are achievable, which are dependent upon material, porosity and thickness of the composite layer 9, and which can be expediently accomplished within the scope of a respective application.

The erosion resistance is significantly improved by the metal layer 11 being closer to the hot side 3 than the ceramic layer 13. Furthermore, however, the metal layer 11 also acts as an upper mounting or fixing for the ceramic layer 13. The metal layer in the present case is provided as a high temperature-resistant sheet metal material, for example in the form of a sheet metal of a nickel-based alloy or other age-resisting alloy, which are suitable to support a ceramic layer. Within the scope of a production method of the composite layer 9, this can easily be adhesively bonded, or otherwise mechanically fastened, onto a ceramic layer 13, so that an intimate connection ensues on the boundary layer 15. As material for the ceramic layer, a ceramic with especially low thermal conductivity, for example a ceramic based on zirconium oxide, has proved to be especially advantageous. The ceramic layer serves for heat insulation. It is expediently also formed from a suitably pressure-resistant material. With this embodiment, an intimate bond of the ceramic and metal layer can also be dispensed with. In order to achieve a composite layer, a metal layer in the form of a sheet metal formed part can first be pressed onto a loosely lying ceramic formed part and the latter retained on the contour by means of a bearing pressure.

A modification of this exemplary embodiment, which is not shown here, could also form a sandwich arrangement in the form of a metal-ceramic-metal composite layer. That is to say, in variation from FIG. 1A, a further metal layer, in the form of a sheet metal layer for reinforcement, could be arranged in a manner in which it lies on the rear side of the ceramic layer 13 and directly on the contour 5. Such a sheet metal, which lies between contour 5 and ceramic layer 13, in comparison to the metal layer 11 which is shown, can be produced from a lower-alloyed sheet metal material on account of its lower temperature level in the operating case, which has price advantages. The sheet metal which directly faces the hot side 3 is manufactured from a more superior sheet metal material.

Figure 1B:
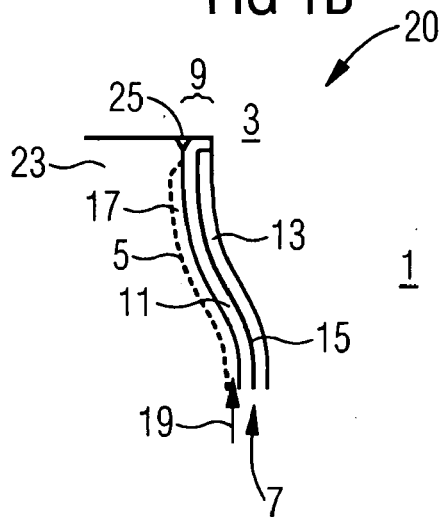
FIG. 1B shows a contour and a lining in the case of a pipe within the scope of a second especially preferred embodiment according to the concept of the invention.

In FIG. 1B, a similar second embodiment of a piping component 20 according to the concept of the invention is shown, in which the parts which correspond to FIG. 1A are otherwise provided with the same designations and are not explained again. Unlike the first embodiment of the piping component 20 in FIG. 1A, in the second embodiment in FIG. 1B the ceramic layer 13 is closer to the hot side 3 than the metal layer 11. Both layers 11, 13 are interconnected on the boundary line 15 in a bonding manner or, if necessary, even only in a positive locking manner.

In the present case, the hot side 3 has the metal and ceramic composite layer 9, forming a spacing distance 17 from the contour 5, i.e. component body 23 and composite layer 9 are spaced away from each other. The spacing distance 17 is formed in the form of a cooling medium feed 19 and is hollow. The lining 9 according to the second embodiment of the piping component 20 in FIG. 1B can be exposed to a back flow of cooling medium, especially cooling steam. The lining 7, in addition to the composite layer 9, is thus also designed with a cooling jacket which is formed by the cooling medium feed.

Figure 2A:
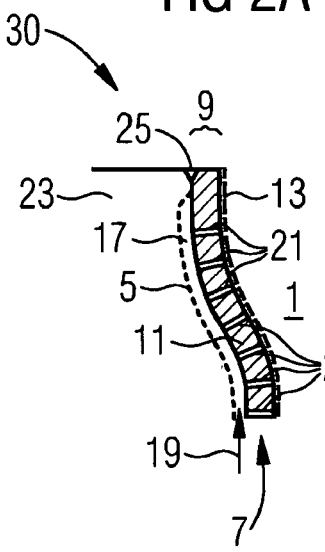
FIG. 2A shows a contour and a lining in the case of an inlet within the scope of a third especially preferred embodiment according to the concept of the invention.
Figure 2B:
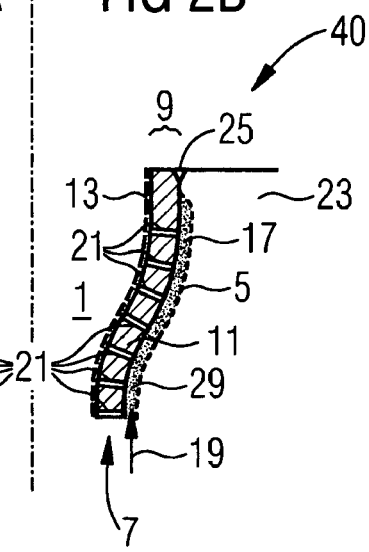
FIG. 2B shows a contour and a lining in the case of an inlet within the scope of a fourth especially preferred embodiment according to the concept of the invention.

A further modification of the cooling jacket is explained with regard to FIGS. 2A and 2B. In this case, features with basically the same function are again provided with the same designations.

FIG. 2A shows a third embodiment of a piping component 30, in this case in the form of an inlet. In this case, the ceramic layer 13 is formed as a thin heat insulating layer on a metal layer 11. In this way, the heat yield as result of the superheated steam from the superheated steam space 1 into the component body 23 is limited. Furthermore, in the third embodiment 30 of FIG. 2A, the metal and ceramic composite layer 9 is provided with holes 21. The otherwise hollow spacing distance 17 serves as a cooling medium feed 19, wherein the cooling medium can escape through the holes 21 into the superheated steam space 1 and so forms a cooling boundary layer on the ceramic layer 13 which is formed as a heat insulating layer, which has an additional heat insulating effect. In the present case, the holes 21 are arranged in the metal layer 11 and in the ceramic layer 13. The ceramic layer 13 can alternatively or additionally also have pores, through which the cooling medium can escape into the superheated steam space 1.

In FIG. 2B, a modification of the third embodiment, which is shown in FIG. 2A, is shown as a fourth embodiment of a piping component 40. Basically the same designations are again used. The fourth embodiment of a piping component 40 has a spacing distance 40 which is filled with a porous and/or mesh-like material 29. This can especially be a porous ceramic or a mesh of fiber material, for example glass or metal fibers.

The support system in the spacing distance 17 which is formed in this way is advantageously slightly elastic, and otherwise supports the composite layer 9 in an advantageous way. Both a hollow spacing distance 17, as in the third embodiment of a piping component 30 of FIG. 2A, and a spacing distance 17 which is filled with a support system in the fourth embodiment of a piping component 40 according to FIG. 2B, decouple the composite layer 9, which is formed by the formed part 27, from the component body 23 in an advantageous way. In this way, the lining 7 is damped to a particular degree against mechanical vibrations, for example as a result of thermal instabilities, for example during transient operating processes, which especially occur in a piping component.

A similar decoupling of component body 23 and formed part 27 can also be achieved by means of the sandwich structure which is explained in detail in conjunction with FIGS. 1A, 1B. In the first embodiment of a piping component 10, within the scope of a modification, an additional metal layer between contour 5 and ceramic layer 13, which is not shown, can have the effect of an additional mounting or fixing backing. In this way, a direct connection of the composite layer 9 of the piping component 10 to the component body 23 during a transient behavior, for example during thermal instabilities, is damped.

Such a sandwich structure or a support system, which is explained with reference to FIG. 2B, increases the operating safety of a piping component 10 or 40 to a significant degree.

All the linings 7 in the embodiments 10, 20, 30, 40 are fastened on the component body 23 by means of a welded connection 25. Other types of connection, such as screwing, riveting, clamping or pinning or the like can alternatively or additionally also be provided. Furthermore, it can also prove to be advantageous that one or more of the number of formed parts 27 are interconnected by a mesh.

This, for example, can be metallic and be embedded in a ceramic layer 13 by sintering. As a result, the formed parts are better interlinked and better supported. The mesh can preferably be fastened on the contour 5.

FIG. 3 shows in a perspective view the piping components 10, 20, 30, 40, in which the lining 7 in the form of a multiplicity of formed parts 27 is formed on the contour 5. Each of the formed parts 27 is adapted to the contour 5 in the region of the formed part 23.

Within the scope of an especially preferred embodiment of a production method, the component body 23 of the piping component 10, 20, 30, 40 is first made available. After this, the lining 7 is applied by a multiplicity of formed parts 27, which form the lining 7, being applied, wherein a contour-adapted formed part 27 is provided in each case, and, conforming to the course of the contour 5, is attached in a manner with a metal and ceramic composite layer 9 oriented towards the hot side 3.

As explained in conjunction with FIGS. 1A, 1B, 2A, 2B, for forming the composite layer a metal layer and a ceramic layer are interconnected in a bonding or positive locking manner. The formed parts 27 themselves, within the scope of the production method and depending upon requirement, are screwed, adhesively bonded, or, as shown in conjunction with the preceding figures, welded by means of a welded connection 25. The aforementioned joining processes prove to be advantageous, especially since they facilitate the installability of the formed parts 27 and improve their mechanical stability in relation to transient thermal processes.

In order to simultaneously impart a high temperature resistance and also mechanical resistance to a component 10, 20, 30, 40 of a steam turbine plant, which component is exposed to admission of superheated steam, the component 10, 20, 30, 40, on a hot side 3 which faces a superheated steam space 1, has a lining 7 which is applied to a component body 23 and adapted to the contour 5 of the component body 23. According to the new concept, the lining 7 has a number of formed parts 27, and a formed part 27 has a metal and ceramic composite layer 9 which is formed from at least one metal layer 11 and at least one ceramic layer 13. The ceramic layer 13 especially serves as an insulating layer. The metal layer 11 especially serves as a support or also for protection against abrasion and/or erosion.

The invention claimed is:

1. A component of a steam turbine plant, for exposure to admission of superheated steam, comprising:

a hot side that faces a superheated steam space, which component has a contour and a lining arranged in a region of the hot side and formed by a plurality of formed parts adapted to the contour and formed as a metal and ceramic composite layer having a metal layer and a ceramic layer, wherein the hot side has the metal and ceramic composite layer, forming a spacing distance from the contour.

2. The component as claimed in claim 1, wherein the ceramic layer is closer to the hot side than the metal layer.

3. The component as claimed in claim 1, wherein the metal layer is closer to the hot side than the ceramic layer.

4. The component as claimed in claim 1, wherein the ceramic layer is arranged between a first metal layer directly adjacent to a second metal layer.

5. The component as claimed in claim 1, wherein the spacing distance is a cooling medium feed.

6. The component as claimed in claim 1, wherein the metal and ceramic composite layer has pores and/or holes.

7. The component as claimed in claim 1, wherein the spacing distance is filled with a porous material.

8. The component as claimed in claim 1, wherein the spacing distance is filled with a mesh-like material.

9. The component as claimed in claim 1, wherein one or more of the plurality of formed parts are connected by a mesh provided for fastening on the contour.

10. The component as claimed in claim 9, wherein the component is a casing component in the inflow region of the steam turbine of the steam turbine plant.

11. The application as claimed in claim 10, wherein the component is exposed to superheated steam at a temperature of above 600° C. and a pressure of above 250 bar.

12. The component as claimed in claim 9, wherein the component is part of a rotor and/or of a blade of the steam turbine of the steam turbine plant.

13. The component as claimed in claim 1, wherein the component is a piping and/or collecting component selected from the group consisting of: a pipe, a header, an outlet header, and a boiler.

14. A steam turbine plant, comprising:

a boiler;

a steam system attached to the boiler that conveys superheated steam; and a steam turbine that receives and expands the steam to provide mechanical energy, wherein the plant contains a component for exposure to superheated steam having:

a hot side that faces a superheated steam space, which component has a contour and a lining arranged in a region of the hot side and formed by a plurality of faulted parts adapted to the contour and formed as a metal and ceramic composite layer having a metal layer and a ceramic layer, wherein the hot side has the metal and ceramic composite layer, forming a spacing distance from the contour.

* * * * *

UNITED STATES PATENT AND TRADEMARK OFFICE

CERTIFICATE OF CORRECTION

PATENT NO. : 8,137,063 B2
APPLICATION NO. : 11/918304
DATED : March 20, 2012
INVENTOR(S) : Detlef Haje, Dietmar Röttger and Friedhelm Schmitz It is certified that error appears in the above-identified patent and that said Letters Patent is hereby corrected as shown below:

Col. 10, line 25, Claim 14, remove [faulted] and insert --formed--

Signed and Sealed this
Twenty-fifth Day of December, 2012

David J. Kappos

David J. Kappos
*Director of the United States Patent and Trademark Office*